US010271616B2

(12) United States Patent
Labbe

(10) Patent No.: US 10,271,616 B2
(45) Date of Patent: Apr. 30, 2019

(54) CLOSURE SYSTEM

(71) Applicant: POWERLACE TECHNOLOGIES INC., St-Hubert, Quebec (CA)

(72) Inventor: Frederick Labbe, St-Hubert (CA)

(73) Assignee: POWERPLACE TECHNOLOGIES INC., Quebec (CA)

( * ) Notice: Subject to any disclaimer, the term of this patent is extended or adjusted under 35 U.S.C. 154(b) by 13 days.

(21) Appl. No.: 15/500,878

(22) PCT Filed: Jul. 31, 2015

(86) PCT No.: PCT/CA2015/050727
§ 371 (c)(1),
(2) Date: Jan. 31, 2017

(87) PCT Pub. No.: WO2016/015161
PCT Pub. Date: Feb. 4, 2016

(65) Prior Publication Data

US 2017/0215525 A1 Aug. 3, 2017

Related U.S. Application Data

(60) Provisional application No. 62/031,220, filed on Jul. 31, 2014, provisional application No. 62/060,745, filed on Oct. 7, 2014.

(51) Int. Cl.
*A43B 11/00* (2006.01)
*A43C 11/16* (2006.01)
(Continued)

(52) U.S. Cl.
CPC ..... *A43C 11/165* (2013.01); *A43B 11/00* (2013.01); *A43C 1/00* (2013.01); *A43C 7/08* (2013.01);
(Continued)

(58) Field of Classification Search
CPC ..... A43B 11/00; A43C 11/00; A43C 11/008; A43C 11/16; A43C 11/165
(Continued)

(56) References Cited

U.S. PATENT DOCUMENTS 4,741,115 A 5/1988 Pazzobon
4,790,048 A 12/1988 Arnt
(Continued)

FOREIGN PATENT DOCUMENTS

CA 2564152 A1 4/2008
DE 29809404 U1 8/1998
(Continued)

OTHER PUBLICATIONS

European Search Report and written opinion issued in related Patent Application No. EP-15827965, dated Mar. 14, 2018.
(Continued)

*Primary Examiner* — Marie D Bays
(74) *Attorney, Agent, or Firm* — Maschoff Brennan

(57) ABSTRACT

A closure system including a body for receiving an object. An activation device is connected to a base structure, and is activated by placement of the object within the closure system. The activation device operates between a raised or depressed configuration, depending on the position of the object within the closure system. A tightening mechanism is responsive to the operation of the activation device. When the activation device is in the raised configuration, the tightening mechanism is loose. When the user depresses the activation device, the tightening mechanism tightens around the object. A movable displacer in a locking device for locking the configuration of the closure system and removably insertable into a recess helps better control tension within the tightening mechanism and improves comfort by disengaging the activation device from the tightening
(Continued)

mechanism. A lace lock for locking a lace is disclosed. A lace tension distributor is also disclosed.

18 Claims, 29 Drawing Sheets

(51) Int. Cl.

| | |
|---|---|
| ***A43C 11/00*** | (2006.01) |
| ***A43C 11/14*** | (2006.01) |
| ***A43C 1/00*** | (2006.01) |
| ***A43C 7/08*** | (2006.01) |
| ***A43C 11/20*** | (2006.01) |

(52) U.S. Cl.
CPC ..... *A43C 11/008* (2013.01); *A43C 11/14* (2013.01); *A43C 11/1493* (2013.01); *A43C 11/20* (2013.01)

(58) Field of Classification Search
USPC ..... 36/50.1, 138
See application file for complete search history.

(56) References Cited

U.S. PATENT DOCUMENTS

| | | | | |
|---|---|---|---|---|
| 5,205,055 | A | 4/1993 | Harrell | |
| 5,335,401 | A | 8/1994 | Hanson | |
| 5,481,814 | A * | 1/1996 | Spencer | A43B 7/00 36/103 |
| 5,511,325 | A | 4/1996 | Hieblinger | |
| 5,600,874 | A | 2/1997 | Jungkind | |
| 5,718,021 | A | 2/1998 | Tatum | |
| 5,839,210 | A | 11/1998 | Bernier et al. | |
| 6,202,953 | B1 | 3/2001 | Hammerslag | |
| 6,427,361 | B1 * | 8/2002 | Chou | A43B 11/00 36/138 |
| 6,467,194 | B1 | 10/2002 | Johnson | |
| 6,643,954 | B2 * | 11/2003 | Voswinkel | A43B 11/00 36/138 |
| 8,087,188 | B2 | 3/2012 | Labbe | |
| 8,769,844 | B2 | 7/2014 | Beers et al. | |
| 2003/0009917 | A1 * | 1/2003 | Voswinkel | A43B 11/00 36/50.1 |
| 2005/0039348 | A1 * | 2/2005 | Raluy | A43B 3/12 36/50.1 |
| 2005/0198867 | A1 * | 9/2005 | Labbe | A43B 11/00 36/50.1 |
| 2007/0209234 | A1 * | 9/2007 | Chou | A43B 11/00 36/50.1 |
| 2009/0223084 | A1 * | 9/2009 | Kaufman | A43C 11/008 36/43 |
| 2010/0319216 | A1 * | 12/2010 | Grenzke | A43B 11/00 36/54 |
| 2011/0146106 | A1 * | 6/2011 | Kaufman | A43C 11/00 36/105 |
| 2014/0082963 | A1 | 3/2014 | Beers | |

FOREIGN PATENT DOCUMENTS

| | | | |
|---|---|---|---|
| KR | 20120079489 | A | 7/2012 |
| WO | 2001015559 | A1 | 3/2001 |
| WO | 2007080205 | A1 | 7/2007 |

OTHER PUBLICATIONS

Written Opinion of the International Searching Authority dated Nov. 2, 2015, as received in Application No: PCT/CA2015/050727.

* cited by examiner

CLOSURE SYSTEM

CROSS-REFERENCE TO RELATED APPLICATION

This application is a U.S. National Stage filing under 35 U.S.C. § 371 of International Application Ser. No. PCT/CA2015/050727, filed on Jul. 31, 2015, which claims priority to U.S. Provisional Patent Application No. 62/031,220, filed on Jul. 31, 2014 and to U.S. Provisional Patent Application No. 62/060,745, filed on Oct. 7, 2014. The foregoing applications are incorporated herein by reference.

FIELD OF THE INVENTION

The invention relates generally to closure systems. Although the invention can relate generally to footwear, and more particularly to a closure system intended to tie shoes, boots, snow shoes, and the like, the invention can also be used to close other types of objects. Another aspect of the invention generally relates to a lace tension distributor. Another aspect of the present invention generally relates to footwear, but more particularly to a lace lock intended to tie shoes, boots, snow shoes, or any article integrating laces.

BACKGROUND OF THE INVENTION

Lacing shoes can be difficult or impossible for some people, and several inventors have tried over the years to simplify the matter.

US patent application 2005/0198867 A1 (now abandoned) by the present inventor describes a self tying shoe where the lacing device is activated by the weight of the user. The weight is transmitted to a mechanism located within the sole, underneath the foot. The large number of moving parts makes the mechanism vulnerable to breakage. In addition, the underneath location of the mechanism causes some discomfort to the foot.

U.S. Pat. No. 4,741,115 relates to a ski boot with an operating assembly for closing and adjustment, and includes a power source supported by the ski boot which operates a driving gearwheel which is selectively engageable with driven gearwheels for winding the cables of closing and/or adjustment devices of the boot.

U.S. Pat. No. 5,205,055 concerns a shoe member including a plurality of securement webs directed about a lacing gap within the shoe upper, wherein the webs are each mounted slidably within associated cavities, with tether lines mounted to the webs operative above a crank pulley. The crank pulley is in operative engagement with a slidable actuator rod to effect projection of the securement webs forcibly within each respective cavity, wherein a gas cylinder is operative to effect rotation of the crank pulley by the use of an associated slide rod within a guide cylinder to effect winding of each associated tether line relative to each associated securement web.

U.S. Pat. No. 5,335,401 describes a device for quickly tightening shoelaces on a shoe and for locking the tightened laces without the need for tying a bow or other knot. The device includes a body unit with a slotted opening formed with a chamfered edge along one side of the slot. A rotatable shaft which includes a set of chamfered ridges rolls laterally across the width of the slot. A shoelace introduced through the slot becomes pinched between the chamfered edge of the slotted opening and the chamfered ridges of the shaft. The shaft is spring biased to automatically lock the laces in place upon being tightened to the desired tension. A quick release lever retracts the shaft to unpinch the lace.

U.S. Pat. No. 5,511,325 shows a shoe having a central rotary closure arranged on the heel of the upper in the area above the location at which the heel bone is received and having at least one tightening element which has a tightening section running from the central rotary closure towards each side of the shoe. The tightening sections are coupled by a coupling element with at least one strap which runs from each tightening section or coupling element over the instep and/or by the arch to the other tightening section or coupling element.

U.S. Pat. No. 5,600,874 shows a central closing device for shoes with a rotationally supported cord disc for at least one cord-type tensioning member for closing the shoe in such a way that the number of rotations of the cord disc is limited without any increase in the space required. Both the cord disc and a stationary member each have mutually-cooperating tooth profiles having the same tooth pitch but of different diameters. Located in the intermediate space created due to the different diameters of the tooth profiles is an idling pinion of the same pitch, which meshes with the two tooth profiles. At least one stop is provided to limit the travel of the idling pinion.

U.S. Pat. No. 5,718,021 shows a device for tying a shoelace on a shoe. The device includes a base and a cover hingedly mounted on the base so as to be pivotable between an open position and a closed position. The base includes a top surface, a bottom surface and first and second holes which are sized and shaped so that the shoelace can be inserted therethrough. The cover includes a top surface, a bottom surface and first and second pins which are aligned so as to project into the first and second holes, respectively, when the cover is in the closed position. The cover also includes a locking tab which engages with a tip on the base to releasably lock the cover in the closed position.

U.S. Pat. No. 5,839,210 shows a shoe incorporating adjustable straps that are positioned to tighten the shoe casing around a wearer's instep. A retractor mechanism incorporates elastic members. The elastic members are charged when the wearer loosens the shoe by pulling on the straps. The stored energy is released when a catch is disengaged and releases the elastic members to tighten and cinch the shoe on the wearer's foot.

U.S. Pat. No. 6,202,953 shows a footwear lacing system that includes a lace attached to a tightening mechanism. The lace is threaded through a series of opposing guide members positioned along the top of the foot and ankle portions of the footwear. The lace and guide preferably have low friction surfaces to facilitate sliding of the lace through the guide members so that the lace evenly distributes tension across the footwear member. The tightening mechanism allows incremental adjustment of the tension of the lace. A release mechanism allows a user to quickly loosen the lace.

U.S. Pat. No. 6,467,194 shows an automated tightening shoe with crisscrossed laces and a tightening mechanism which operates in one direction to cause automatic tightening of the crisscrossed laces to tighten the shoe about a wearer's foot, and which can be released easily so that the shoe can be removed from the wearer's foot.

Some inventions involve a manual tightening mechanism which is integrated into the outsole area while others use retractable heels latched on the shoe. Still other systems use a central closing device that involves manual winding. All these inventions need to be operated by hand. Another system involves the use of pneumatic means.

Canadian patent CA2564152, by the present inventor, describes weight-activated tying footwear being worn on a foot of a user so as to allow the user to easily tighten the footwear around the foot. The footwear includes a body for receiving the foot. An activation device is connected to the sole of the body, and is activated by the foot of the user. The activation device operates between a raised or depressed configuration, depending on the position of the foot in the footwear. A tightening mechanism within a vertical wall of the body is responsive to the operation of the activation device. When the activation device is in the raised configuration, the tightening mechanism is loose around the foot of the user. When the user depresses the activation device in the depressed configuration, the tightening mechanism becomes tight around the user's foot. However, the mechanism, in certain scenarios, can be subject to breakage due to fatigue stresses.

U.S. Pat. No. 4,790,048 describes a shoelace lock including top and bottom plates that cross and grip the laces as the top plate is rotated 180 degrees to the bottom plate and snap locked thereto. This design is somewhat bulky and requires a snap lock mechanism.

Hence, in light of the aforementioned, there is a need for a closure system which, by virtue of its design and components, would be able to overcome or at least minimize some of the aforementioned prior art problems.

There is also a need for a lace tension distributor that can facilitate use of a closure system.

There is also a need for an improved lace locking system which, by virtue of its design and components, can constitute an improvement over prior art systems.

SUMMARY OF THE INVENTION

The object of the present invention is to provide a closure system, which by virtue of its design and components, satisfies some of the above-mentioned needs and is thus an improvement over other related closure systems and/or methods known in the prior art, used for self-lacing or self-tightening, or other similar applications.

In accordance with the present invention, one of the above objects is achieved, as will be easily understood, with a closure system, such as the one briefly described herein, and such as the one exemplified in the accompanying drawings.

More particularly, and according to the present invention, there is provided a closure system comprising:

a body having a base structure and at least two opposed side walls projecting from the base structure so as to define a cavity for receiving an object;

an activation device actuatable by placement of the object within the closure system, the activation device being housed within the body and operable between a raised configuration and a depressed configuration; and at least one tightening mechanism housed within at least one vertical side wall of the body at a vertical distance from the base structure, the at least one tightening mechanism functionally connectable to the body and operatively responsive to the activation device such that the at least one tightening mechanism tightens the body around the object upon a transition of the activation device between the raised configuration to the depressed configuration, and the at least one tightening mechanism loosens the body from the object upon a transition of the activation device from the depressed configuration to the raised configuration, the at least one tightening mechanism comprising at least one linkage assembly, each linkage assembly comprising:

at least one tension element operatively linking the activation device to the body;

a movable displacer for displacing the at least one tension element along a path upon the transition of the activation device from the raised configuration to the depressed configuration thus tightening the body around the object, and for returning the at least one tension element along the path to an original loose configuration upon the transition of the activation device from the depressed configuration to the raised configuration thus untightening the body from the object;

a locking device operatively connected to the at least one tension element and removably engageable with the movable displacer, the locking device being operable between a locked configuration wherein the locking device engages the movable displacer, thus preventing movement of the displacer along the path, with the activation device in the depressed configuration, and a displaceable configuration wherein the locking device selectively disengages movable displacer allowing the displacer to freely move along the path upon transitioning of the activation device from the raised configuration to the depressed configuration; and a releasing device mounted onto the body and functionally connected to the movable displacer, the releasing device being configured for unlocking the locking device from the locked configuration to the displaceable configuration, wherein the locking device further comprises a locking insert displaceable by movement of the movable displacer and linked to the tension element, the locking insert being removably insertable into a recess formed proximate a trajectory of the movable displacer, whereby, upon entry of the locking insert into the recess, tension is maintained in the tension element independently of the movable displacer and the activation device is disengaged from the tension element, and, upon removal of the object from the activation device and upon disengaging the releasing device, a movement of the movable displacer removes the locking insert from the recess and relieves tension from the tension element.

According to the present invention, there is also provided a lace lock comprising:

a top member comprising a first aperture defining a primary channel traversing the top member from a first end to a second end; and a bottom member shaped to fit within the channel traversing the top member, the bottom member comprising:

a closed top end;

an open bottom end; and a plurality of oppositely positioned side-channels shaped and sized to guide laces on opposite sides of the closed top end to converge towards the open bottom end, wherein upon positioning of laces between the top and bottom members, displacement of the closed top end of the bottom member towards the top member compresses and locks the laces between the side-channels of the bottom member and the primary channel of the top member, and displacement of the open bottom end of the bottom member towards the top member releases the laces therefrom.

According to the present invention, there is also provided a lace tension distributor for distributing tension between a pulling wire and a lace assembly, the distributor comprising:

a first receiving structure on a first side of the distributor configured for receiving the pulling wire; and a second receiving structure on a second side of the distributor configured for receiving the lace assembly, wherein a first effective cross-sectional area of the pulling wire is less than a second effective cross-sectional area of the lace assembly.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF PREFERRED EMBODIMENTS OF THE INVENTION

In the following description, the same numerical references refer to similar elements. The embodiments, geometrical configurations, materials mentioned and/or dimensions shown in the figures or described in the present description are preferred embodiments only, given for exemplification purposes only.

Moreover, although the present closure system was primarily designed for self-tightening around the foot of the user from the application of the user's weight, via at least one tightening mechanism, it may be used for other types of purposes and with other types of objects, and in other fields, as apparent to a person skilled in the art. For this reason, expressions such as "shoe", "foot", "sole", etc., used herein should not be taken as to limit the scope of the present invention and includes all other kinds of objects or fields with which the present invention could be used and may be useful. The closure system can be used with a variety of objects, including, but not limited to gloves, skates, boots, bicycle helmets, prosthetics and the like.

Moreover, in the context of the present invention, the expressions "shoe", "footwear", "boot", "sandal", and "slipper", as well as any other equivalent expressions and/or compounds word thereof known in the art, will be used interchangeably, as apparent to a person skilled in the art.

In addition, although the embodiments of the present invention as illustrated in the accompanying drawings may comprise various components, and although the preferred embodiment of the weight-activated tying footwear as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperation thereinbetween, as well as other suitable geometrical configurations may be used for the weight-activated tying footwear and corresponding components according to the present invention, as will be briefly explained hereinafter and as can be easily inferred herefrom by a person skilled in the art, without departing from the scope of the invention.

Having discussed some of the principal components and features of the closure system (1) according to the present invention, other preferential embodiments will be further discussed hereinbelow.

Figure 1:
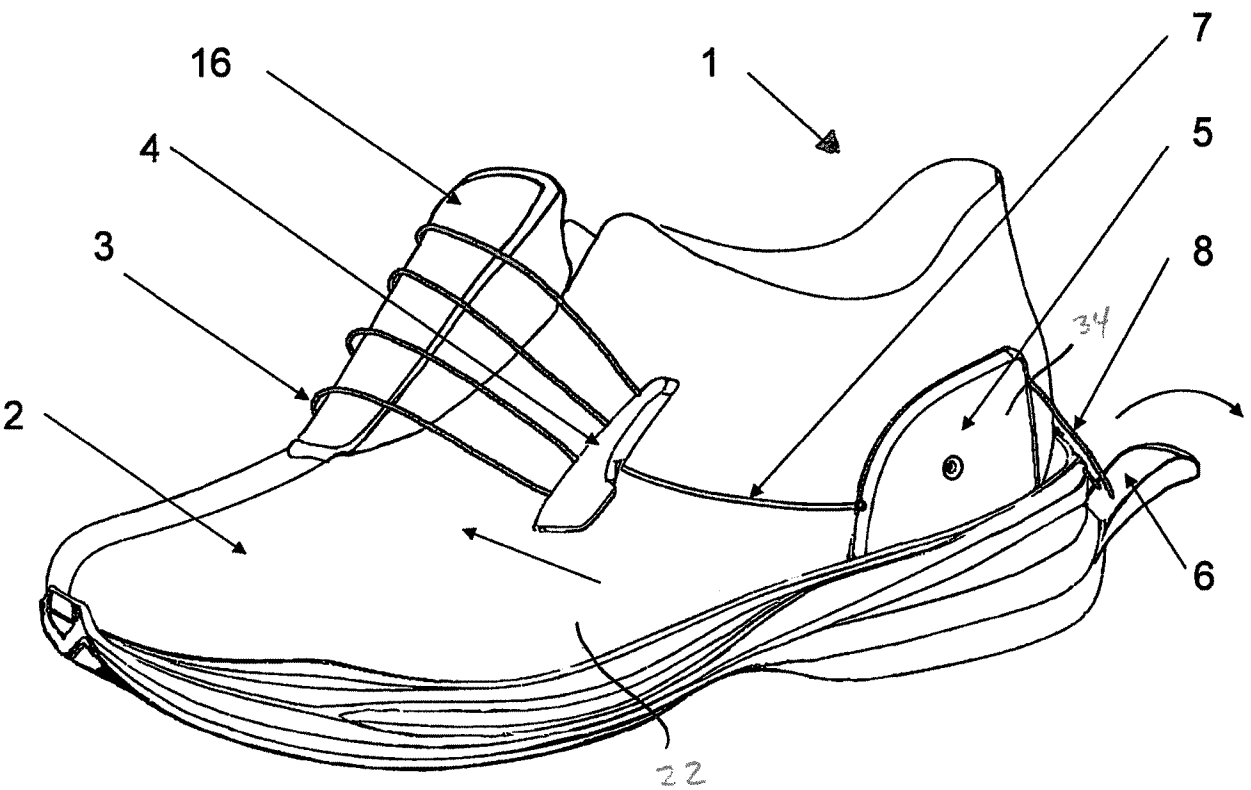
FIG. 1 is a perspective view of a weight-activated tying shoe according to an embodiment of the present invention.
Figure 4:
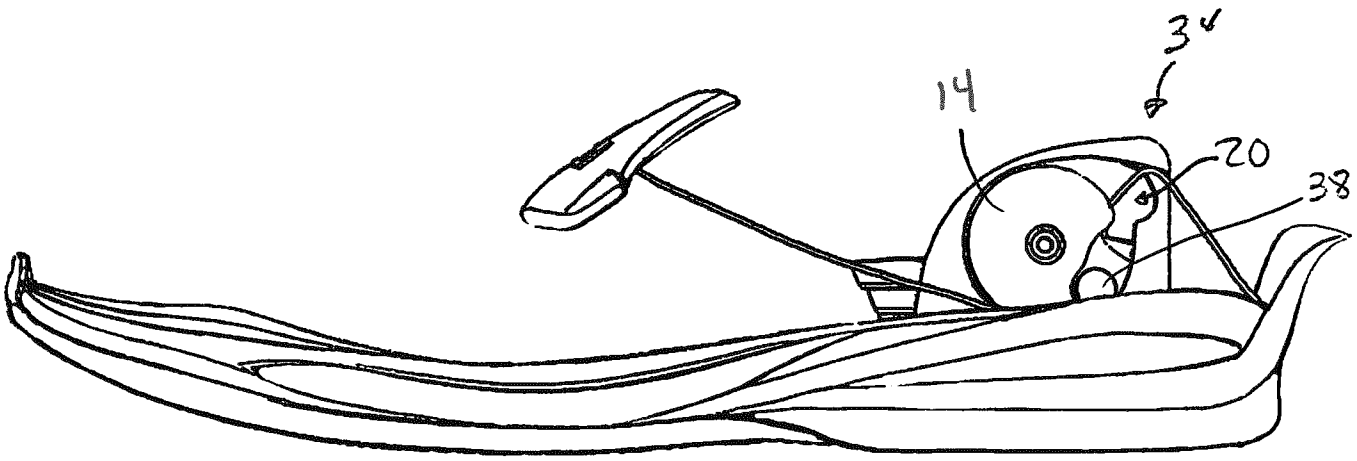
FIG. 4 is a side view of interior components of the shoe shown in FIG. 1, an activation device being shown in an upward position.
Figure 5:
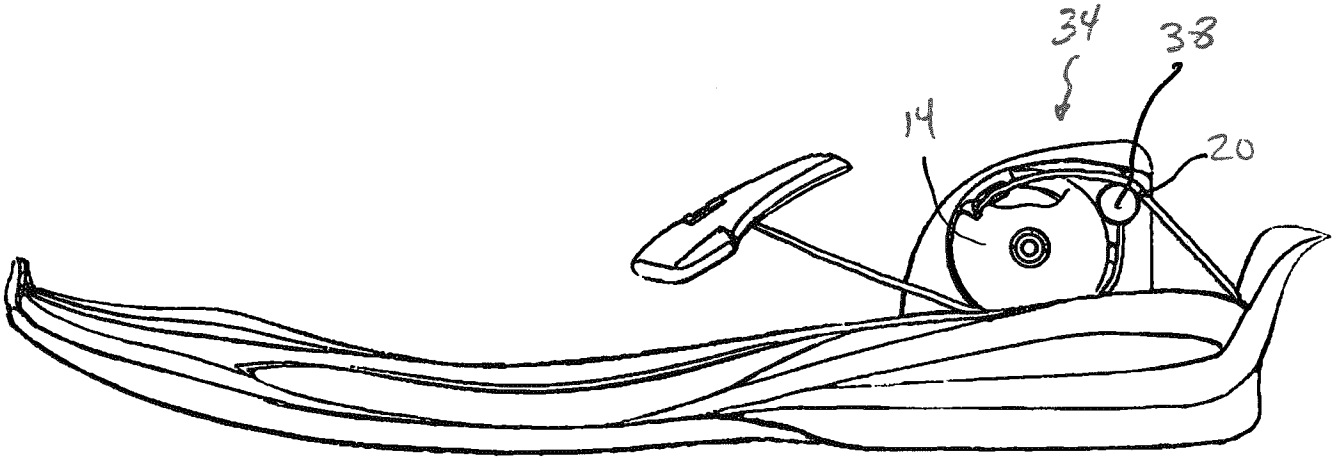
FIG. 5 is another side view of interior components of the shoe shown in FIG. 4, the activation device being shown in a downward position.
Figure 6:
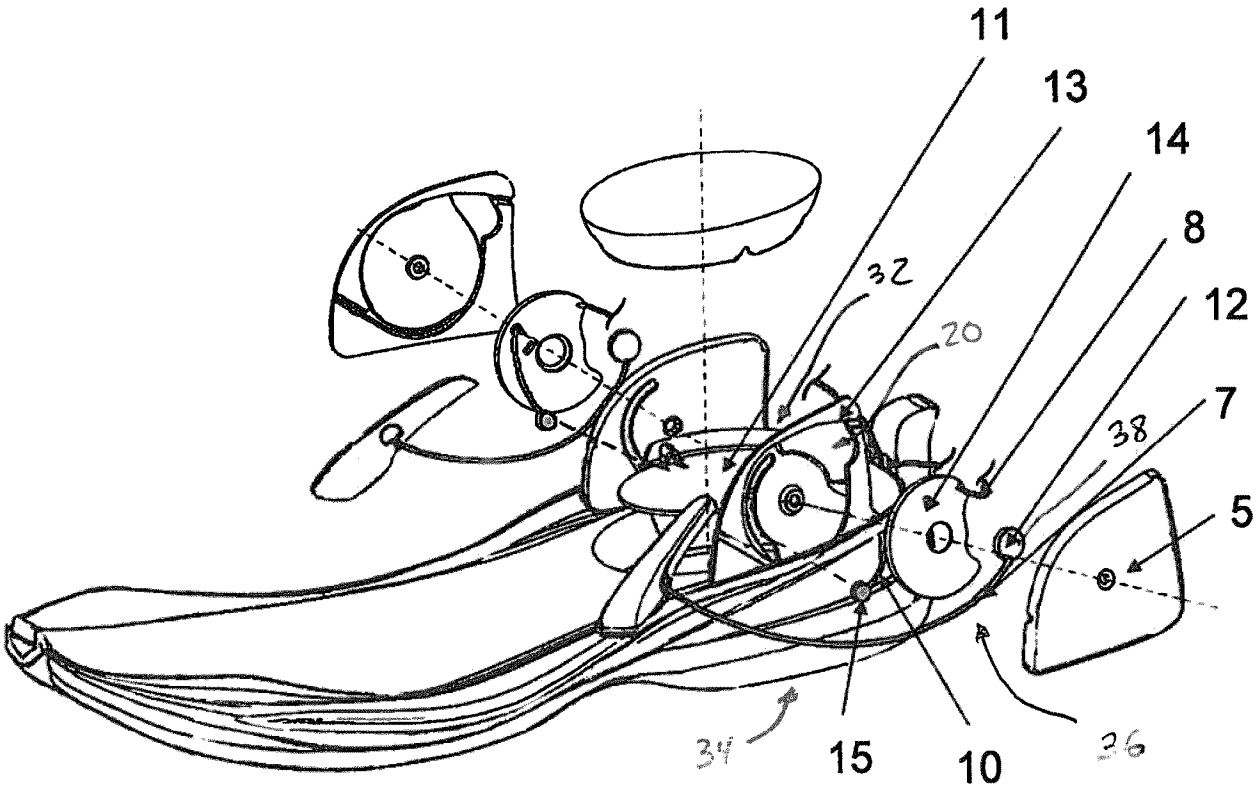
FIG. 6 is an exploded perspective view of interior components of the shoe shown in FIG. 3.

Referring to FIGS. 1 and 6, although the illustrated embodiment shows two symmetrical lateral closure systems, a single closure system works. FIGS. 1 to 6 show an embodiment of the closure system (1) applied to footwear. The closure system includes a body (2) having a base structure, such as a sole for footwear, and at least two opposed side walls (22) projecting from the base structure (2) so as to define a cavity for receiving an object, such as a foot in footwear.

As better shown in FIG. 6, the closure system (1) includes an activation device (32) actuatable by placement of the object, such as a foot, within the closure system (1). The activation device (32) is housed within the body (2) and operable between a raised configuration and a depressed configuration.

Referring to FIG. 6, a tightening mechanism (34) is housed within at least one vertical side wall (22) of the body (2) at a vertical distance from the base structure. The tightening mechanism (34) is functionally connectable to the body (2) and operatively responsive to the activation device (32) such that the tightening mechanism (34) tightens the body (2) around the object upon a transition of the activation device (32) between the raised configuration to the depressed configuration. The tightening mechanism (34) loosens the body (2) from the object upon a transition of the activation device (32) from the depressed configuration to the raised configuration.

The tightening mechanism (34) includes a linkage assembly (36). The linkage assembly (36) includes a tension element, such as pulling wires (7) operatively linking the activation device (32) to the body (2).

A movable displacer, such as a rotatable movable displacer (14), displaces the tension element along a path upon the transition of the activation device (32) from the raised configuration to the depressed configuration thus tightening the body (2) around the object (as shown in part on FIG. 5). The movable displacer returns the tension element along the path to an original loose configuration upon the transition of the activation device (32) from the depressed configuration to the raised configuration thus untightening the body (2) from the object (as shown in part on FIG. 4). The movable helps better control tension within the tightening mechanism and improves comfort by disengaging the activation device from the tightening mechanism.

A locking device (38), for example a pellet element (12) engageable with a recess (20), is operatively connected to the tension element and is removably engageable with the movable displacer. The locking device is operable between a locked configuration wherein the locking device engages the movable displacer, thus preventing movement of the displacer along the path, with the activation device in the depressed configuration (as shown in part on FIG. 5), and a displaceable configuration wherein the locking device selectively disengages movable displacer allowing the displacer to freely move along the path upon transitioning of the activation device from the raised configuration to the depressed configuration (as shown in part on FIG. 4).

Figure 7:
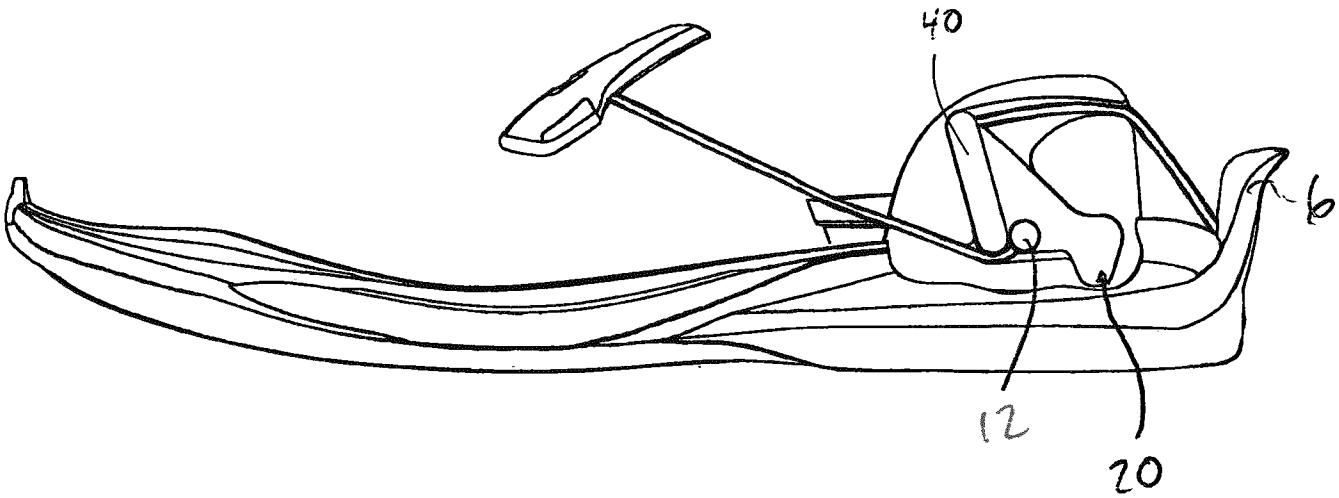
FIG. 7 is a side view of interior components of a shoe according to another embodiment of the present invention, an activation device being shown in an upward position.
Figure 8:
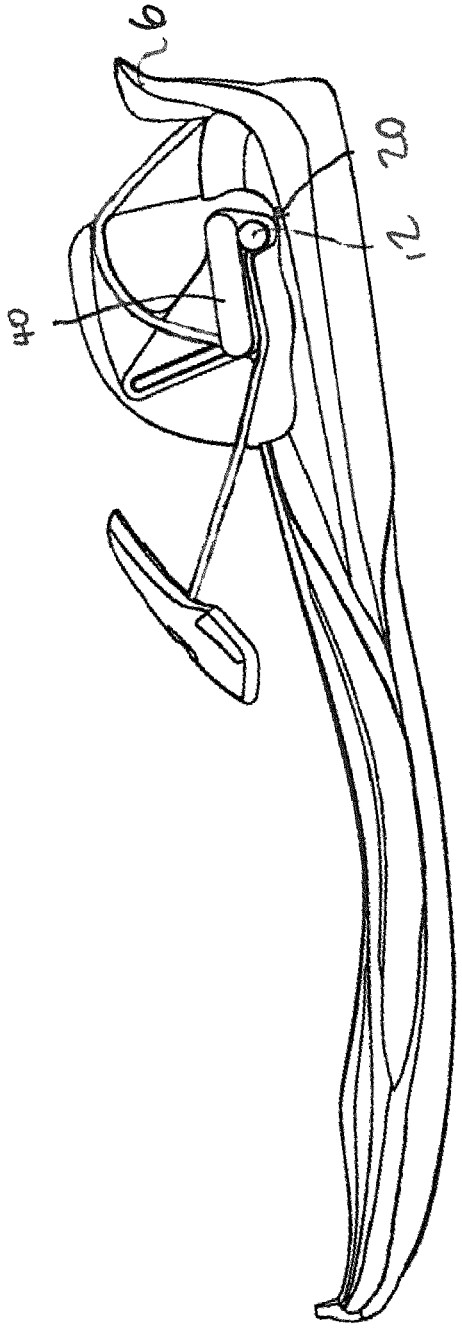
FIG. 8 is a side view of interior components of the shoe shown in FIG. 7, the activation device being shown in a downward position.

FIGS. 7 and 8 illustrate another embodiment of an interaction of a locking device (38) with a movable displacer, in this case a linear element (40) which displaces the pellet element (12) from a displaceable configuration (shown in FIG. 7) to a locked configuration (shown in FIG. 8).

Figure 9:
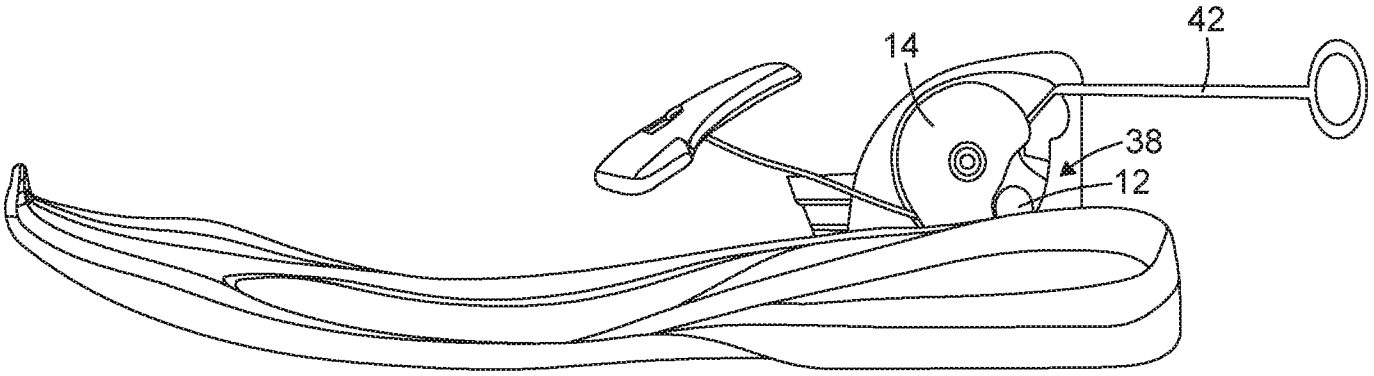
FIG. 9 is a side view of interior components of a shoe according to another embodiment of the present invention, an activation device being shown in an upward position.
Figure 10:
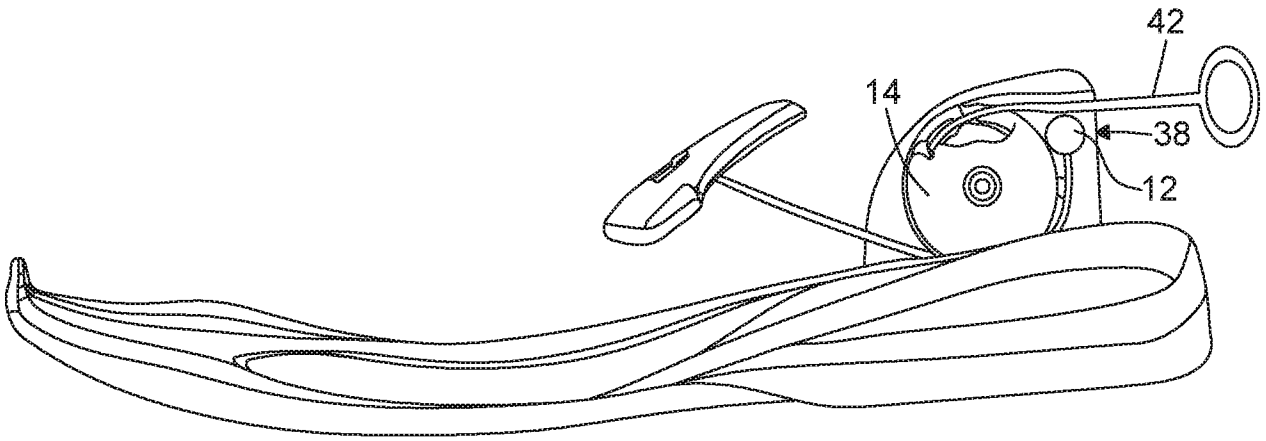
FIG. 10 is a side view of interior components of the shoe shown in FIG. 9, the activation device being shown in a downward position.

The closure system (1) further includes an releasing device, for example a articulated lever (6) shown in FIGS. 1 to 8, mounted onto the body (2) and functionally connected to the movable displacer. The releasing device (6) is configured for unlocking the locking device (38) from the locked configuration to the displaceable configuration, FIGS. 9 and 10 illustrate another embodiment of an releasing device, a pulling tab (42) that is connected to the rotatable movable displacer (14).

In some illustrated embodiments, the locking device (38) includes a locking insert, such as a pellet element (12), displaceable by movement of the movable displacer and linked to the tension element or pulling wires (7). The locking insert is removably insertable into a recess (20) formed proximate a trajectory of the movable displacer, whereby, upon entry of the locking insert into the recess (20), tension is maintained in the tension element independently of the movable displacer and the activation device is disengaged from the tension element. Upon removal of the object from the activation device and upon disengaging the releasing device, a movement of the movable displacer removes the locking insert from the recess and relieves tension from the tension element.

In some implementations, the object is an appendage or a head of a person and the closure system is integrated to a garment.

In other implementations, as shown in the figures, the garment is selected from the group comprising footwear, gloves, hats, helmets, and prostheses.

In some implementations, where the garment is footwear, as shown in FIGS. 1 to 6, the base structure is a sole of the footwear, the movable displacer is a rotatable movable displacer, the releasing device is a articulated lever, the locking insert is a pellet element, the linkage assembly is a side winch. The tightening mechanism comprises two side winches, each side winch being oppositely and symmetrically housed in a corresponding side wall of the body at an offset distance from the sole. The footwear also includes, among other components, an outer casing (5), an inner casing (13), a rotatable movable displacer (14), a lace tension distributor (4), a pellet element (12), an activation cable (10) with a stop ring (15), a release cable (8) and a pulling wire (7). The footwear also includes, as the activation device, a activation dome (11) under the heel connected to the rotatable movable displacer (14) through actuation of the cables (10,15). A foam activation dome (9) is connected to the rigid dome (11) under the heel. The release cable (8) is connected to the rotatable movable displacer (14) and the releasing device or release articulated lever (6). Pulling wires (7) are connected to the lace tension distributor (4) on one side and a pellet element (12) on the other. During tightening of the footwear, the pellet element (12) is pushed by the rotatable movable displacer (14) and moves within the inner and outer casings (5,13) to a recess (20) (better shown in FIGS. 4 and 5) which keeps the tension within the pulling wires (7) and the lace tension distributor (12) independently of the rotatable movable displacer (14). This configuration allows disengagement of the activation device or dome (11) from the pulling wires (7) at a given position (with the lace tension distributor (4) in low position). Laces (3), preferably 4 or more, are connected to lace tension distributor (4). When pushing on the untying articulated lever (6) at the same time as raising a heel to remove the foot from the footwear, tension in the release cable (8) rotates the rotatable movable displacer (14) in the clockwise direction which allows reengagement of the pellet element (12) and removal of tension from the lace tension distributor (4).

Figure 2:
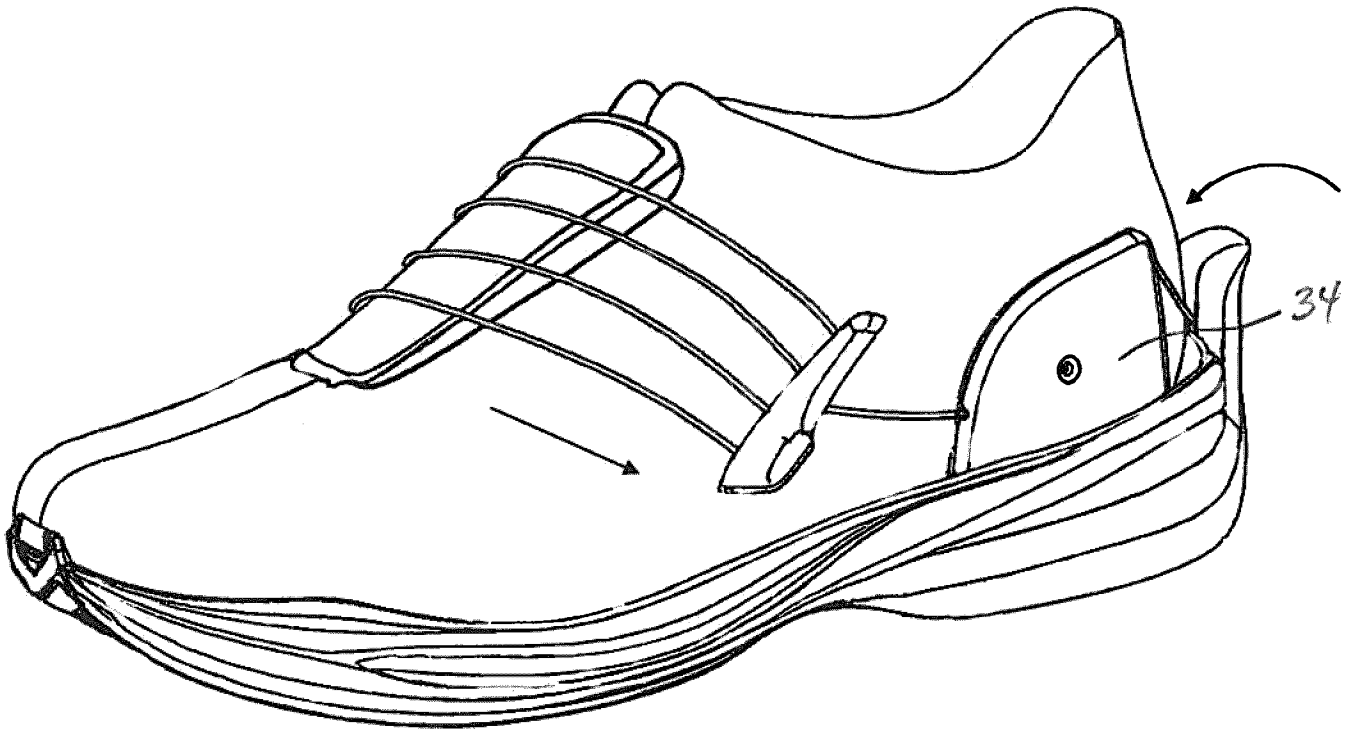
FIG. 2 is another perspective view of what is shown in FIG. 1, an activation device of the shoe being shown in a downward position.
Figure 3:
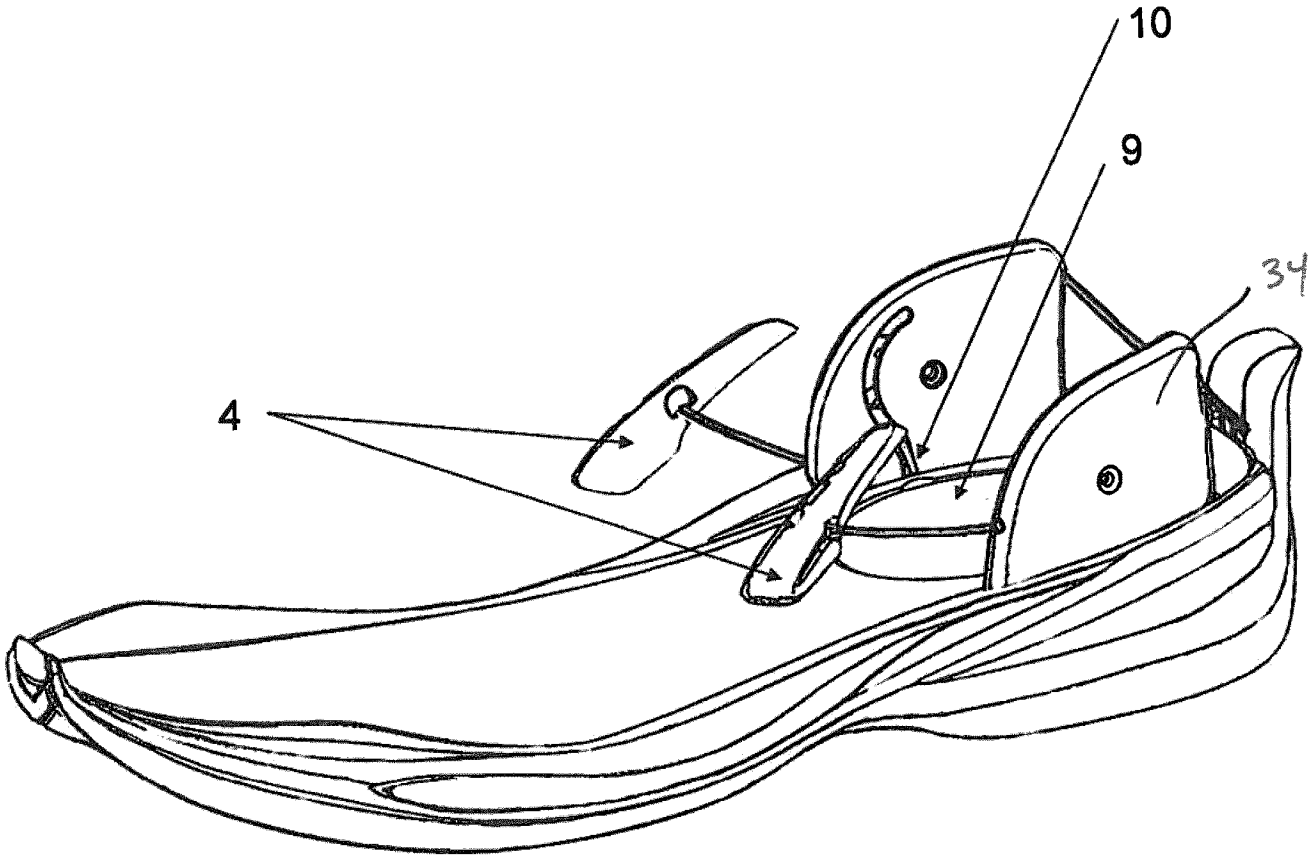
FIG. 3 is a perspective view of interior components of the shoe shown in FIG. 1.

Referring to FIGS. 1 and 2 respectively, the opened-shoe and closed shoe configurations are shown.

FIG. 4 shows the lace tension distributor (4) in a released configuration, with the activation dome components (9,11) in a raised configuration and the activation cable between the rotatable movable displacer (14) and the activation dome components (9,11)

FIG. 5 shows the lace tension distributor (4) in a tightened configuration, with the activation dome components (9,11) in a lowered configuration and the activation cable between the rotatable movable displacer (14) and the activation dome components (9,11). In some implementations, the footwear includes a casing housing the rotatable movable displacer, and the locking device.

In some implementations, the articulated lever is connectable to the locking device by a connector.

In some implementations, the articulated lever is mounted to a rear of the body.

In some implementations, the tension element and the connector are attachments selected from the group consisting of cables, strings, chords, and straps.

In some implementations, the activation device is made of a flexible material.

In some implementations, the activation device comprises an inner sole.

In some implementations, the activation device is connectable to the at least one tightening mechanism via a link plate.

In some implementations, the link plate is made of a rigid material.

In some implementations, the body further comprises a tongue for covering the cavity, the tongue comprising at least one constricting device for tightening the tongue around a foot of the user, wherein the at least one constricting device is selected from the group consisting of a strap, a tie, a belt, a lace, a string, a wire, a cable, and a hook-and-loop fastener.

In some implementations, the constricting device is connectable to an end of the tension element.

In some implementations, the raised configuration is defined by a raised angle with respect to the ground that is formed by the activation device when the foot of the user is removed from the body, and wherein the depressed configuration is defined by the activation device being substantially parallel to the ground when the foot of the user is received in the body.

In implementations where the closure system is used with footwear or shoes, such a footwear and/or shoe provides an efficient way to tie shoes using the weight of the user who, upon sliding his foot inside the shoe, will depress a movable activation device. This activates a tightening mechanism preferably comprising of a winch with a cable system used to close the body of the shoe towards the user's foot, thus lacing the shoe. The user simply uses his weight to activate the mechanism. Using his other foot, the user can move a articulated lever to release the mechanism's tension. Moreover, the pellet element in the locking device for locking the configuration of the footwear and removably insertable into a recess helps better control tension within the tightening mechanism, and improves the durability of the locking device.

FIGS. 14 to 19 illustrate another embodiment of the closure system wherein the tightening mechanism (34) is located on a rear portion of the footwear. As better shown in FIGS. 16 and 17, the releasing device (6) includes a rotary knob. Rotation of the knob allows displacement of the pellet elements (12) between the open shoe and closed shoe configurations shown in FIG. 18 or 19.

Figure 27:
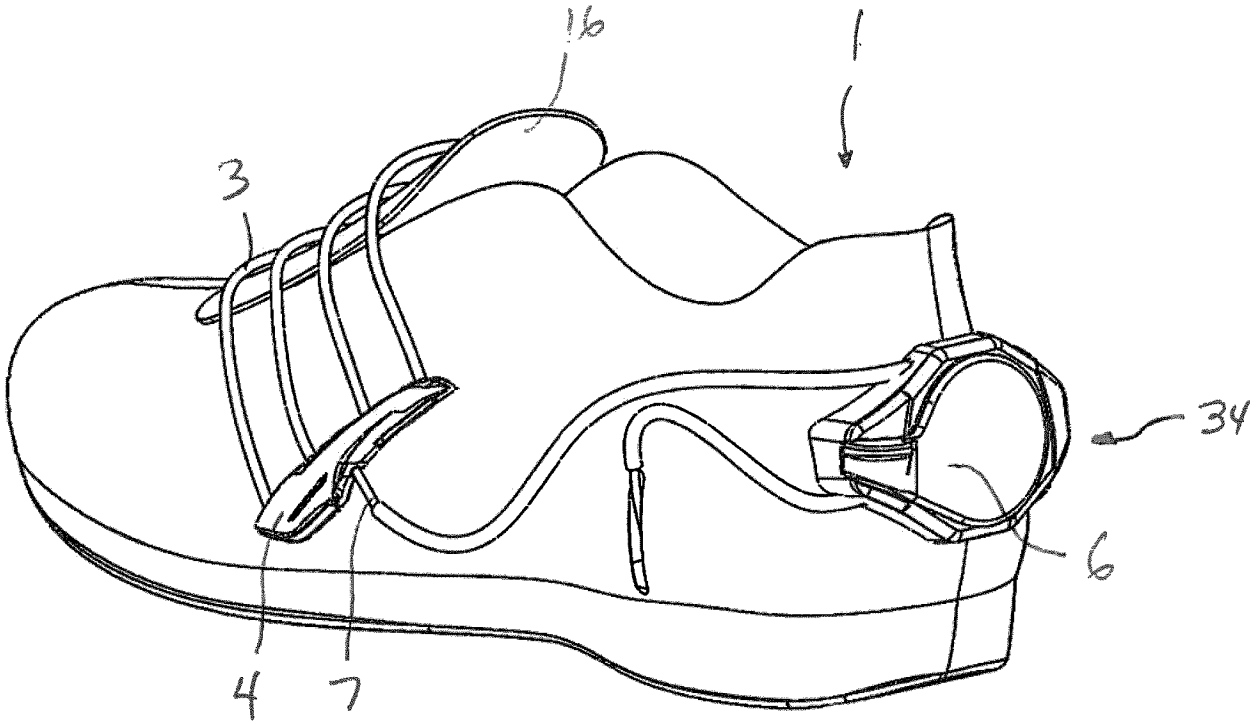
FIG. 27 is a rear perspective view of a closure system according to another embodiment of the present invention in a lace-tightened configuration.
Figure 28:
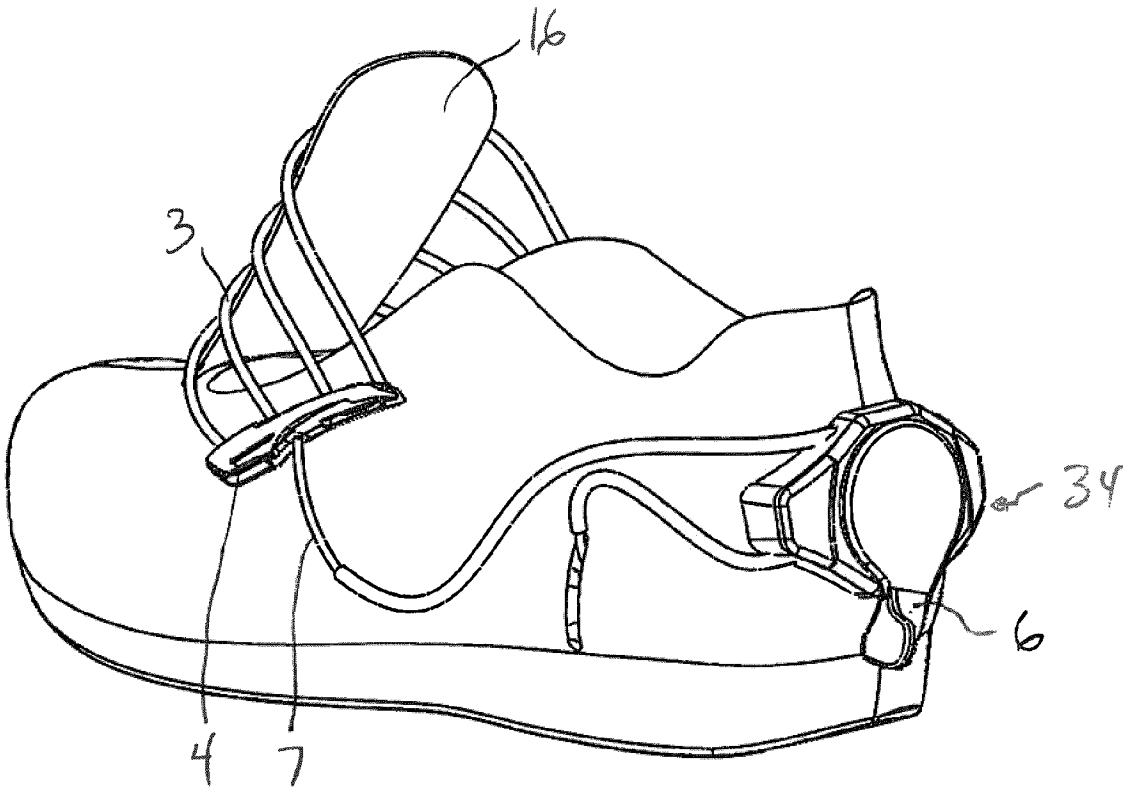
FIG. 28 is a rear perspective view of the closure system shown in FIG. 27, in a lace-untightened configuration.

FIGS. 27 and 28 illustrate an alternate embodiment of the closure system (1) with the tightening mechanism (34) on a rear portion of the footwear and illustrate another embodiment of the releasing device (6) with a rotatable knob.

Figure 29:
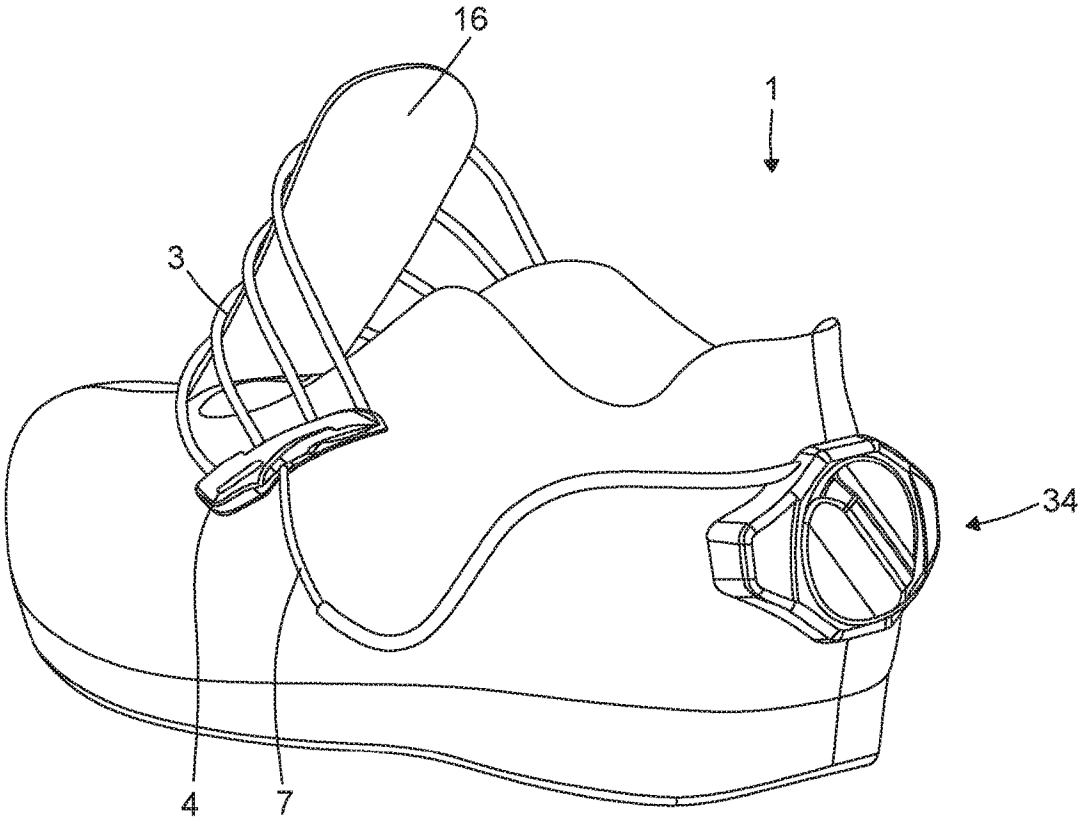
FIG. 29 is a rear perspective view of a closure system according to another embodiment of the present invention.

FIG. 29 illustrates yet another embodiment of the closure system (1) where an activation device (32) actuatable by placement of the object, such as a foot, within the closure system (1), is no longer required. The tightening mechanism (34) can be manually actuated to induce tension into the pulling wire (7) and tighten the body of the footwear for example. As will be explained in more detail below, a lace tension distributor (4) helps distribute the tension of the pulling wire (7) over to the plurality of laces (3) even though the pulling wire (7) carries out relatively small displacements through its tightening.

Figure 11:
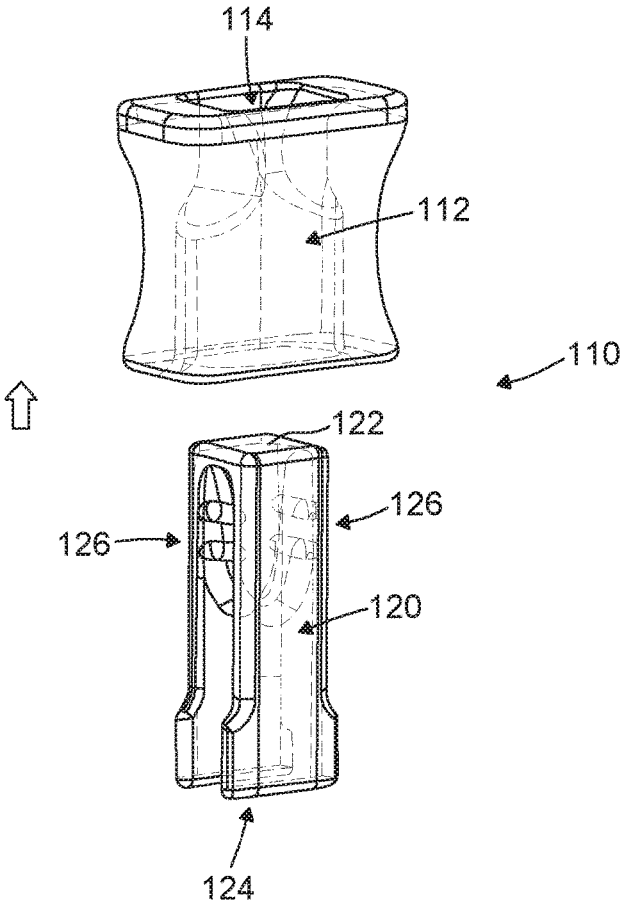
FIG. 11 is a perspective view of a lace lock according to an embodiment of the present invention.
Figure 12:
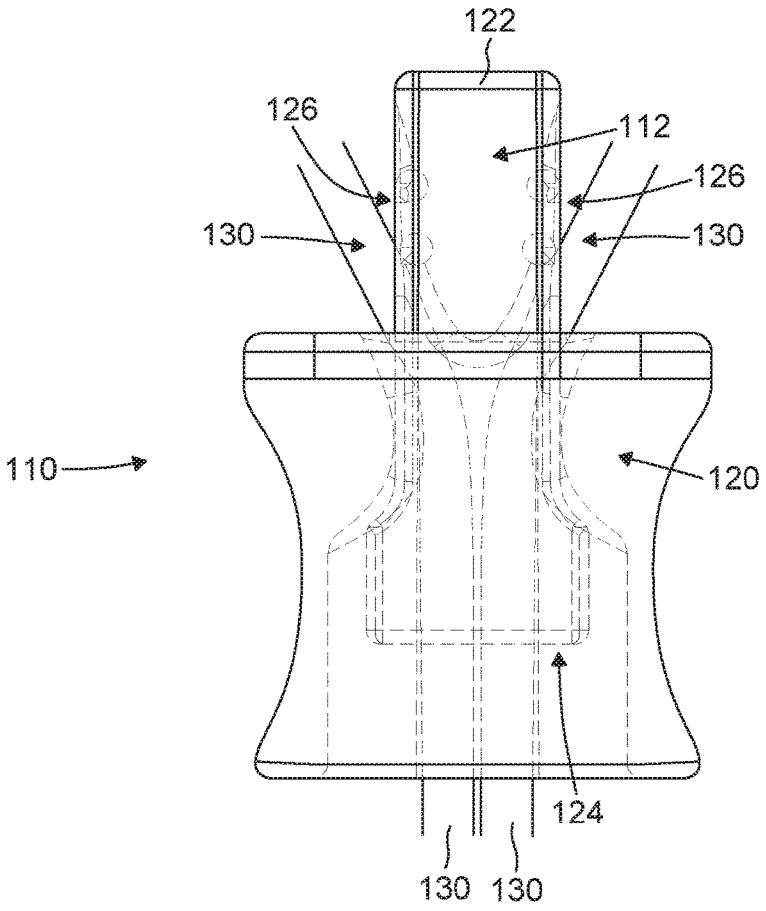
FIG. 12 is a front and partially cross-sectional view of the lace lock shown in FIG. 11, with laces inserted therein and with the lace lock in an open position.
Figure 13:
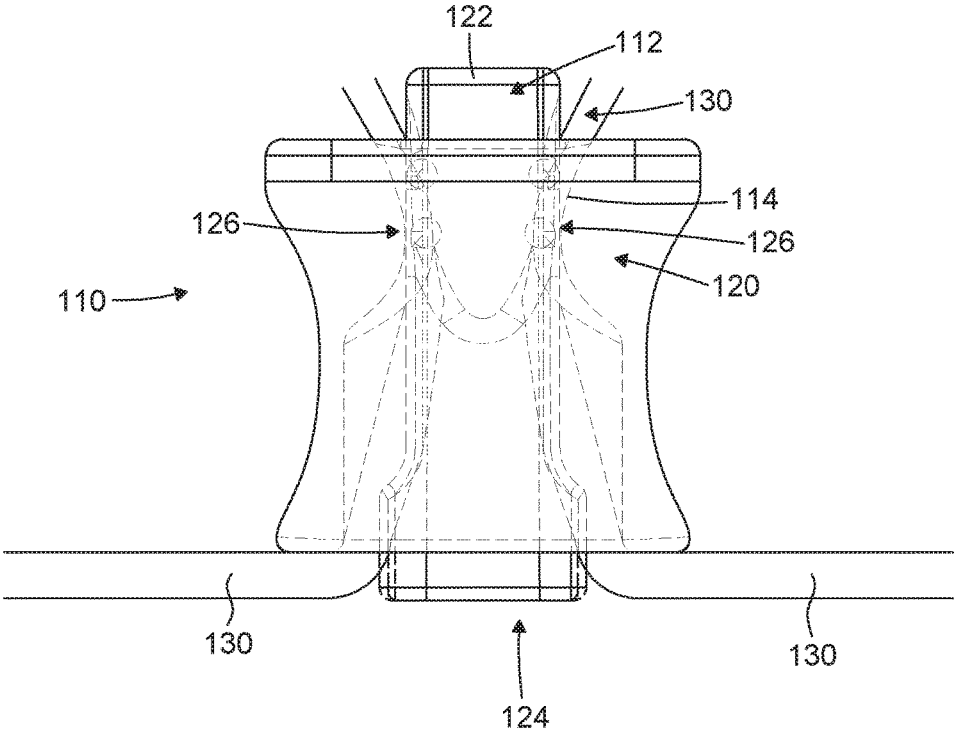
FIG. 13 is a front and partially cross-sectional view of the lace lock shown in FIG. 11, with laces inserted therein and with the lace lock in a closed position.
Figure 14:
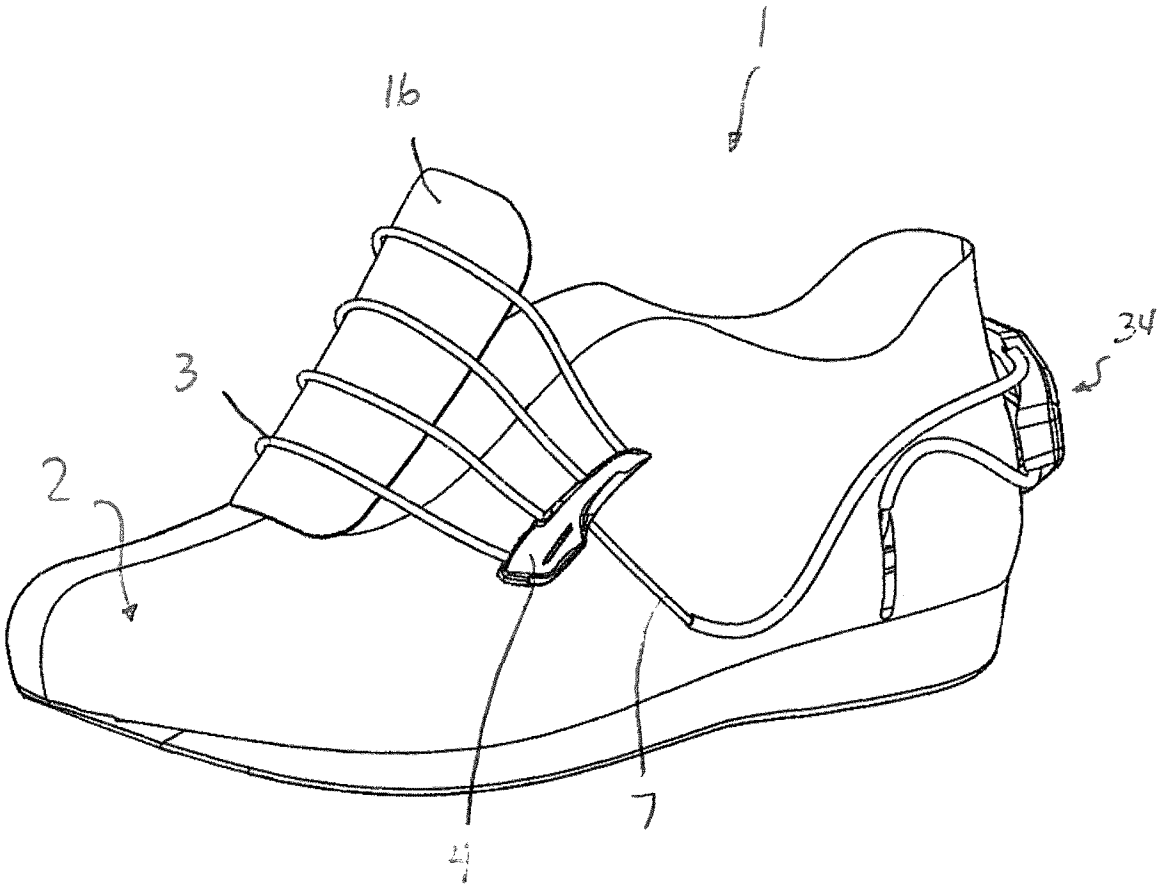
FIG. 14 is a perspective view of a closure system for a shoe according to an embodiment of the present invention.
Figure 15:
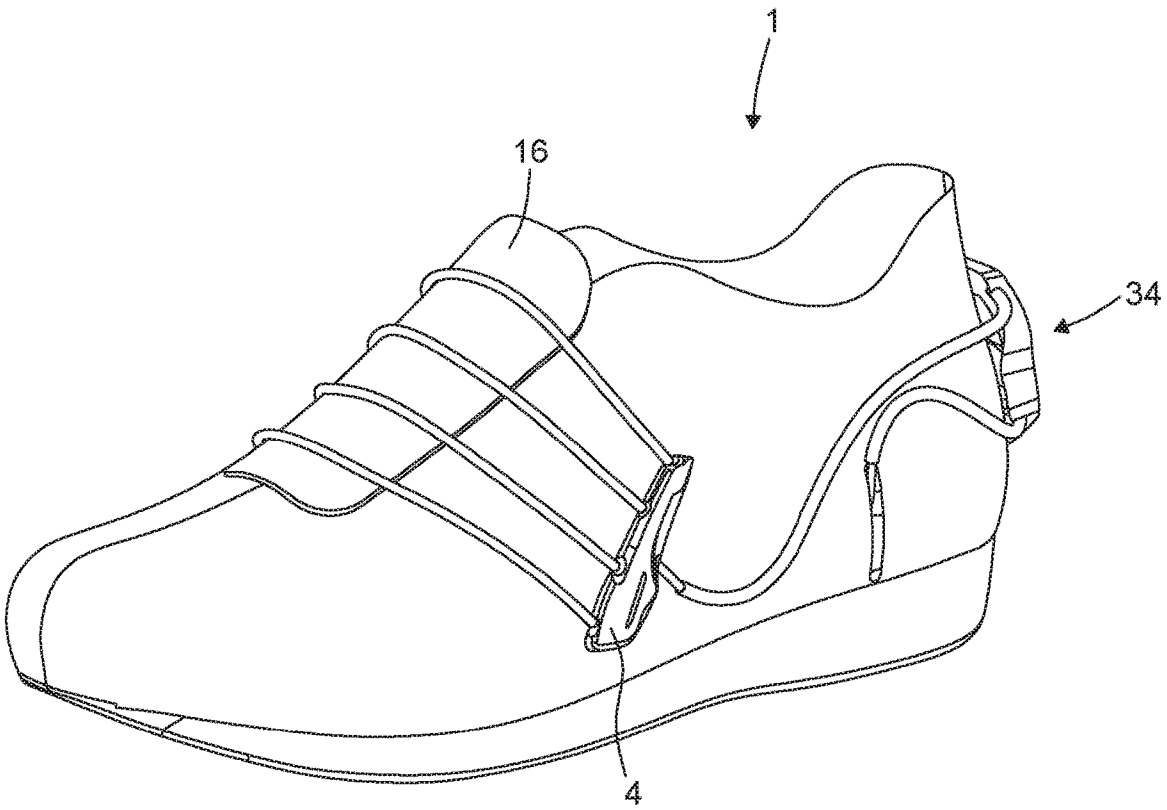
FIG. 15 another perspective view of what is shown in FIG. 1, in a lace tightened configuration.
Figure 16:
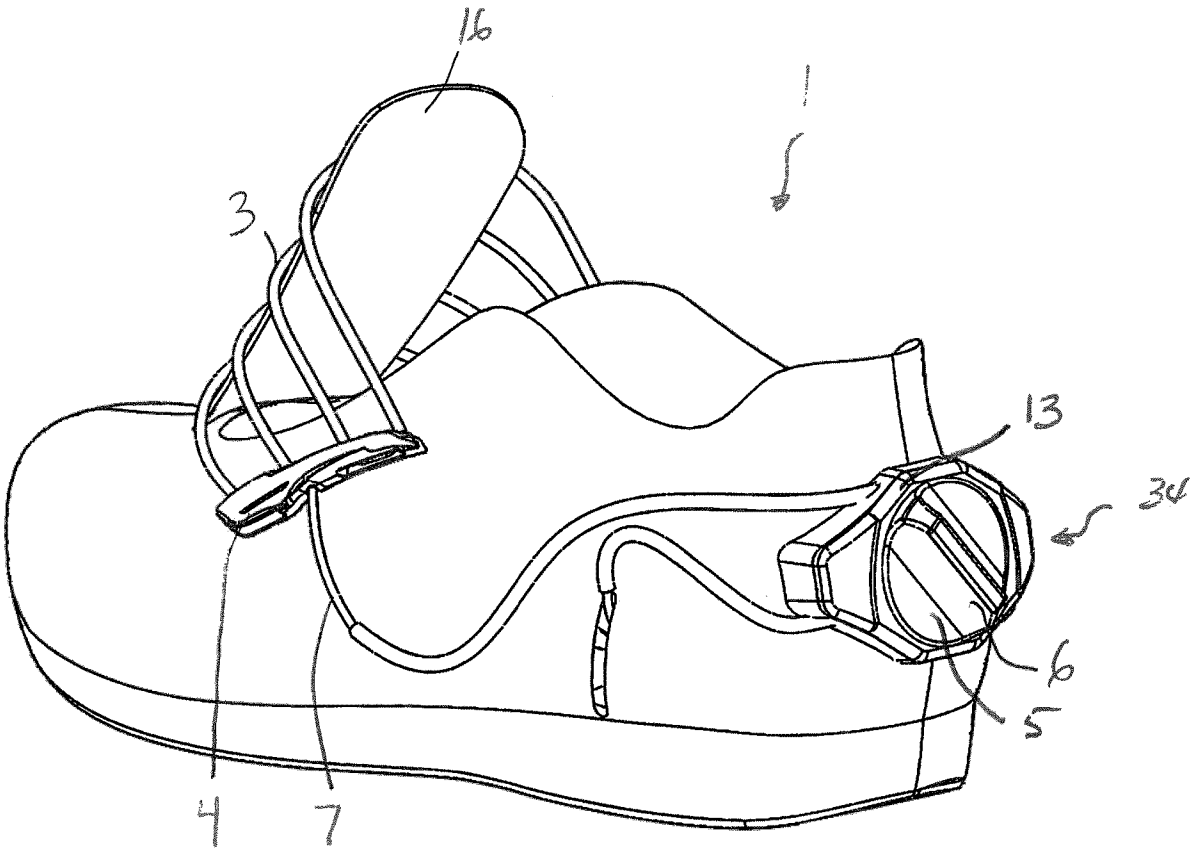
FIG. 16 is a rear perspective view of the closure system shown in FIG. 14.
Figure 17:
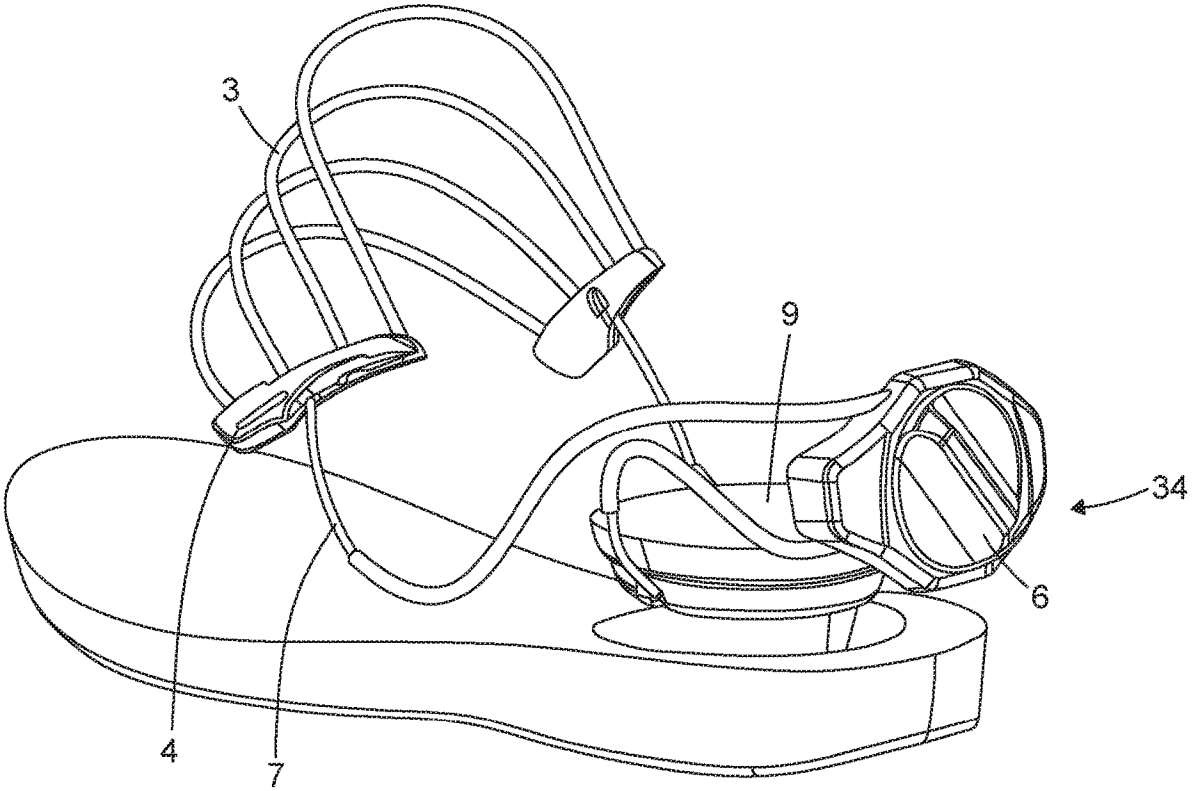
FIG. 17 is a perspective view of interior components of the shoe shown in FIG. 14.
Figure 18:
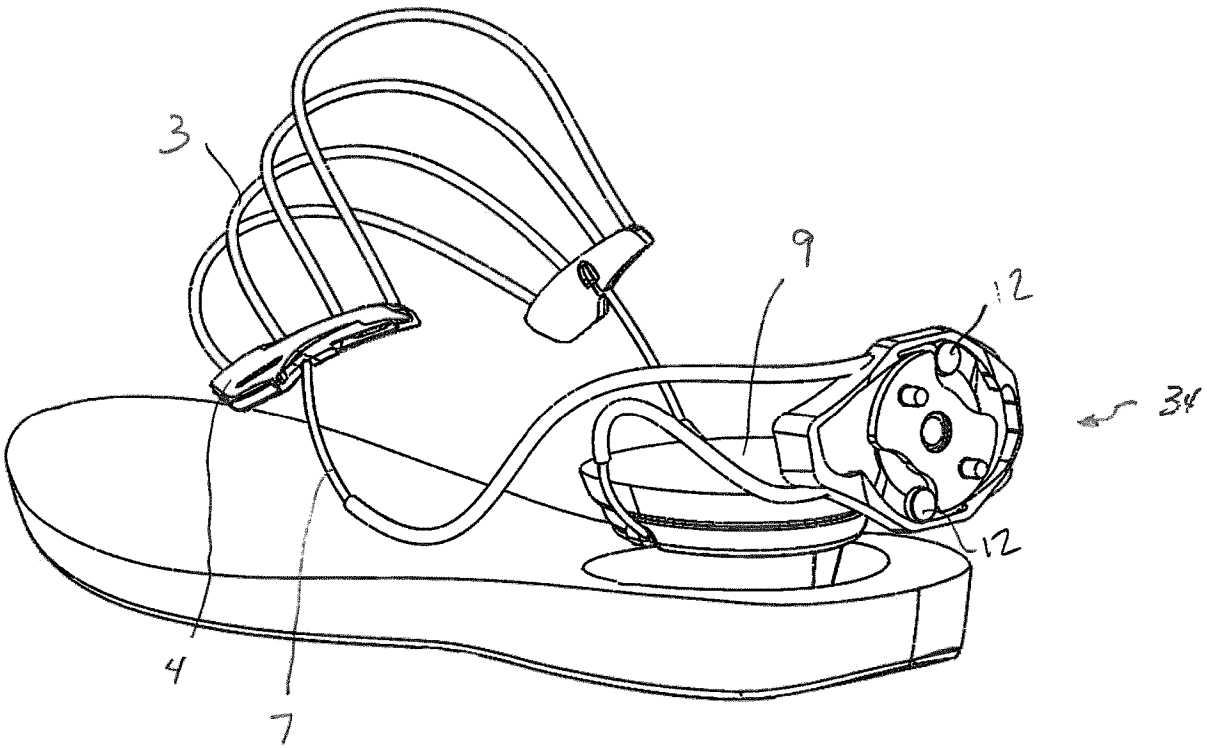
FIG. 18 is a perspective view of interior components of the closure system shown in FIG. 14 with the laces in an untightened configuration.
Figure 19:
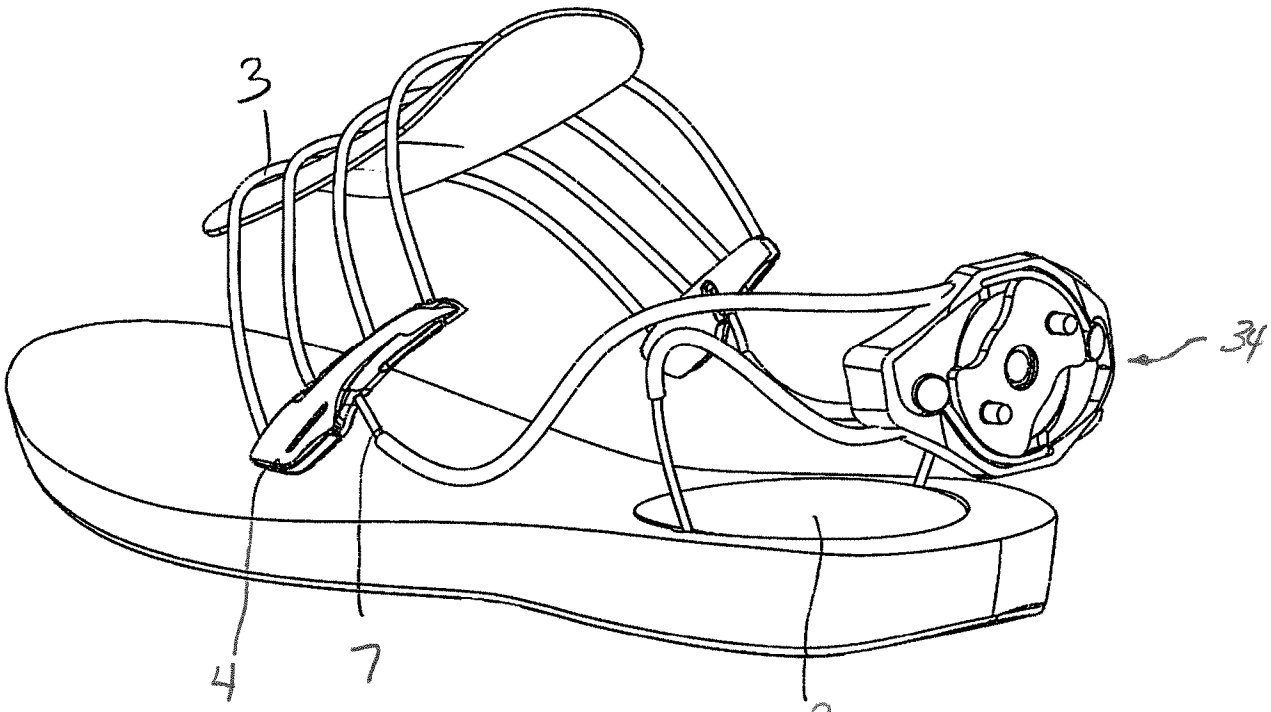
FIG. 19 is a perspective view of interior components of the closure system shown in FIG. 14 with the laces in a tightened configuration.

According to another aspect of the present invention, referring to FIGS. 11 to 13, a lace lock (110) is provided. The lace lock (110) includes a top member (112) having a first aperture defining a primary channel (114) traversing the top member (112) from a first end (116) to a second end (118). A bottom member (120) is shaped to fit within the primary channel (114) traversing the top member (112). The bottom member (120) includes a closed top end (122), an open bottom end (124), and a plurality of oppositely positioned side-channels (126) shaped and sized to guide laces (130) on opposite sides of the closed top end (122) to converge towards the open bottom end (124). Upon positioning of laces (130) between the top and bottom members (112), (120), displacement of the closed top end (122) of the bottom member (120) towards the top member (112) compresses and locks the laces (130) between the side-channels (126) of the bottom member (120) and the primary channel (114) of the top member (112), as better shown in FIG. 3. Displacement of the open bottom end (124) of the bottom member (120) towards the top member (112) releases the laces (130) therefrom, as better shown in FIG. 2. The above lace lock can be integrated to footwear comprising the above-described closure system or can be used on any article having laces thereon.

Figure 25:
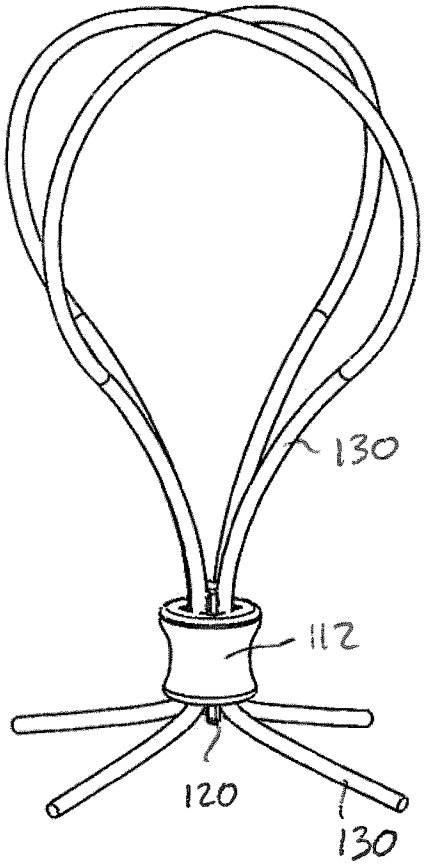
FIG. 25 is a perspective view of a lace lock according to another embodiment of the present invention.
Figure 26:
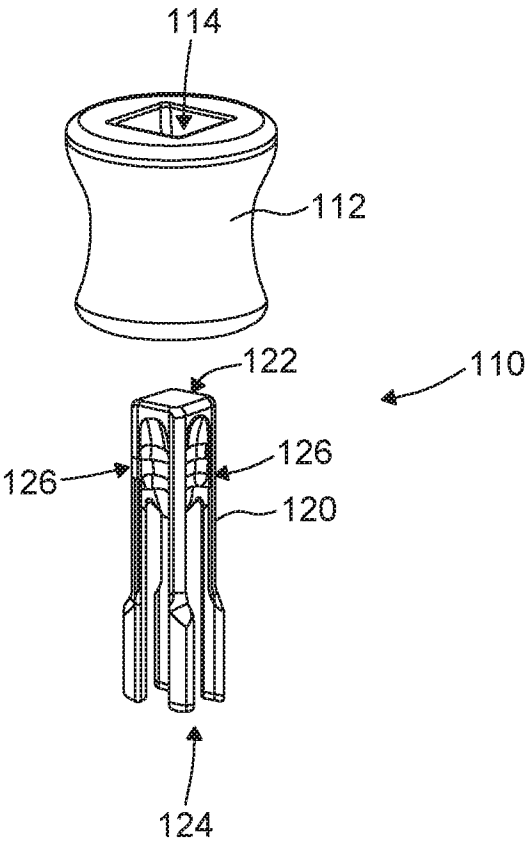
FIG. 26 is an exploded view of the lace lock shown in FIG. 25.

FIGS. 25 and 26 show another embodiment of the lace lock (110) wherein up to four or more laces (130) are locked between the top member (112) and the bottom member (120)

According to another aspect of the present invention, referring to FIGS. 20 to 24, a lace tension distributor (4) is shown. The distributor can distribute tension between a pulling wire (50) and a lace assembly (52), As better shown in FIG. 21, the distributor (4) includes a first receiving structure (54) on a first side of the distributor (4) configured for receiving the pulling wire (50), and a second receiving structure (56) on a second side of the distributor (4) configured for receiving the lace assembly (52), A first effective cross-sectional area of the pulling wire (50) is less than a second effective cross-sectional area of the lace assembly (52). This change in effective cross-sectional area effectively distributes tensile stresses from a single pulling wire to any type of secondary lacing assembly. Use of such a distributor is particularly relevant for the above-described closure elements where tension elements have to distribute tightening tension over the body or footwear through relatively small displacements of the tension elements or pulling wires.

Figure 20:
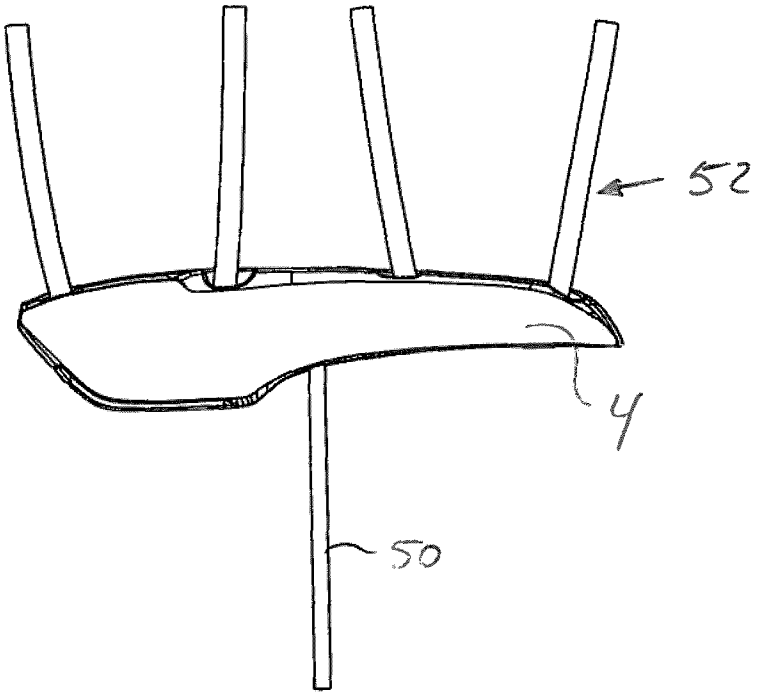
FIG. 20 is a front view of a lace tension distributor according to an embodiment of the present invention.
Figure 21:
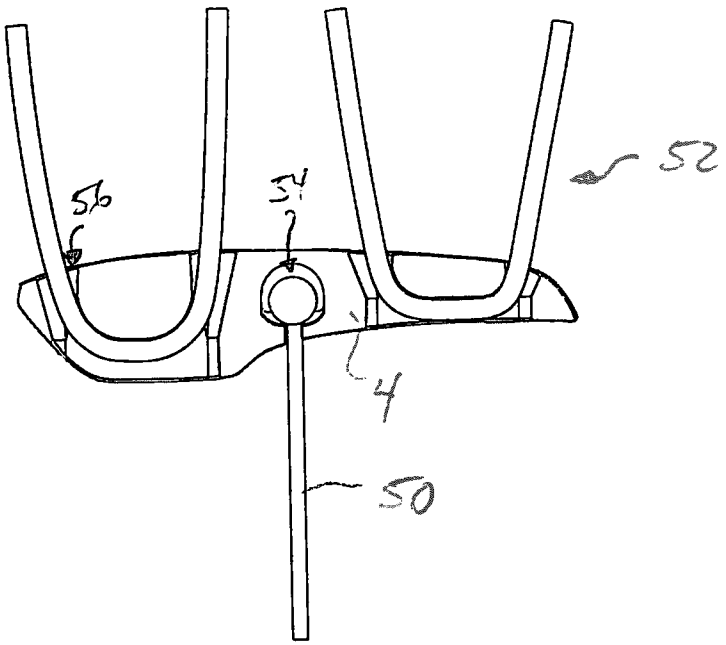
FIG. 21 is a cut view of the lace tension distributor shown in FIG. 20.
Figure 22:
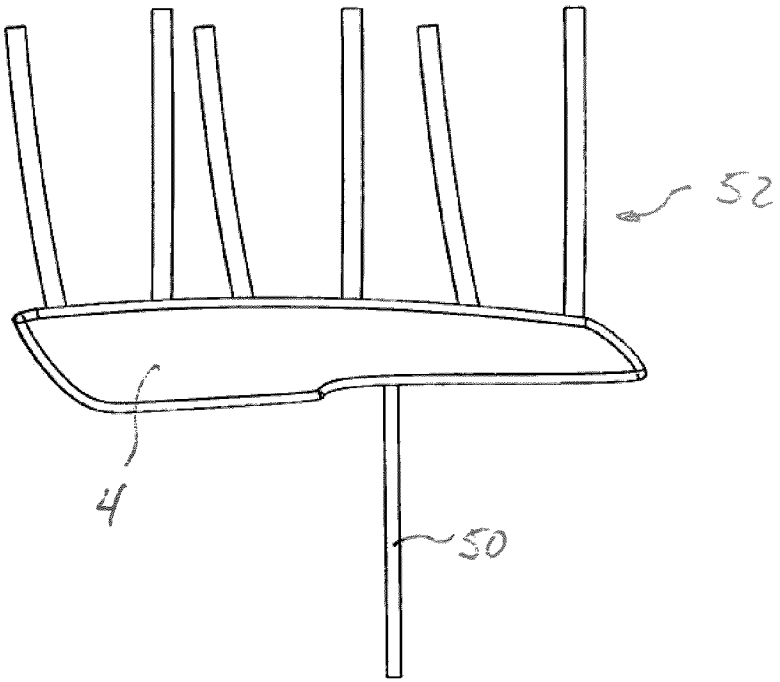
FIG. 22 is a front view of a lace tension distributor according to another embodiment of the present invention.
Figure 23:
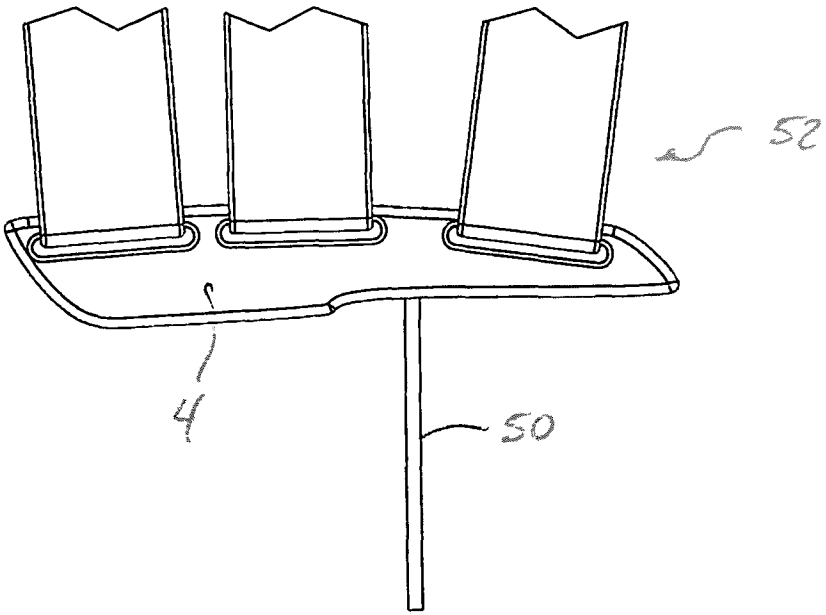
FIG. 23 is a front view of a lace tension distributor according to another embodiment of the present invention.
Figure 24:
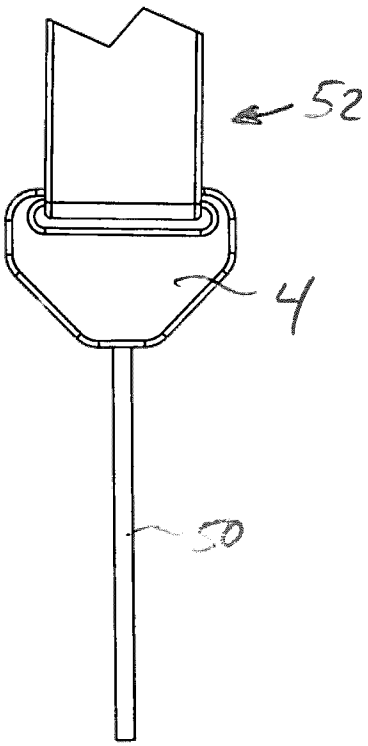
FIG. 24 is a front view of a lace tension distributor according to another embodiment of the present invention.

As shown in FIGS. 20 to 22, in some implementations, the second receiving structure is configured to receive a plurality of laces, with possible varying numbers of laces As shown in FIGS. 23 and 24, in some implementations, the second receiving structure is configured to receive at least one flat lace, such as a single flat lace shown in FIG. 24 or a plurality of flat laces as shown in FIG. 23. The flat laces can include, for example, hook and loop fastener laces or ribbed/irregular surface laces that can allow fastening when interacting with a locking element.

The scope of the claims should not be limited by the preferred embodiments set forth in the examples, but should be given the broadest interpretation consistent with the description as a whole.

What is claimed is:

1. A closure system comprising:

a body having a base structure and side walls projecting from the base structure so as to define a cavity for receiving an object;

an activation device actuatable by placement of the object within the closure system, the activation device being housed within the body and operable between a raised configuration and a depressed configuration; and at least one tightening mechanism housed within at least one side wall of the body, the at least one tightening mechanism functionally connectable to the body and operatively responsive to the activation device such that the at least one tightening mechanism tightens the body around the object upon a transition of the activation device between the raised configuration to the depressed configuration, and the at least one tightening mechanism loosens the body from the object upon a transition of the activation device from the depressed configuration to the raised configuration, the at least one tightening mechanism comprising at least one linkage assembly, each linkage assembly comprising:

at least one tension element operatively linking the activation device to the body;

a movable displacer for displacing the at least one tension element along a path upon the transition of the activation device from the raised configuration to the depressed configuration thus tightening the body around the object, and for returning the at least one tension element along the path to an original loose configuration upon the transition of the activation device from the depressed configuration to the raised configuration thus untightening the body from the object;

a locking device operatively connected to the at least one tension element and removably engageable with the movable displacer, the locking device being operable between a locked configuration wherein the locking device engages the movable displacer, with the activation device in the depressed configuration, and a displaceable configuration wherein the locking device selectively disengages movable displacer allowing the displacer to freely move along the path upon transitioning of the activation device from the raised configuration to the depressed configuration; and a releasing device mounted onto the body and functionally connected to the movable displacer, the releasing device being configured for unlocking the locking device from the locked configuration to the displaceable configuration, wherein the locking device further comprises a locking insert displaceable by movement of the movable displacer and linked to the tension element, the locking insert being removably insertable into a recess formed proximate a trajectory of the movable displacer, whereby, upon entry of the locking insert into the recess, tension is maintained in the tension element independently of the movable displacer and the activation device is disengaged from the tension element, and, upon removal of the object from the activation device and upon disengaging the releasing device, a movement of the movable displacer removes the locking insert from the recess and relieves tension from the tension element.

2. The closure system according to claim 1, wherein the object is an appendage or a head of a person and the closure system is integrated to a garment.

3. The closure system according to claim 2, wherein the garment is selected from the group comprising footwear, gloves, hats, helmets, and prostheses.

4. The closure system according to claim 2, wherein the garment is footwear, the base structure is a sole of the footwear, the movable displacer is a linear movable displacer, the releasing device is an articulated lever, and the locking insert is a pellet element.

5. The closure system according to claim 2, wherein the garment is footwear, the base structure is a sole of the footwear, the movable displacer is a rotatable movable displacer, the releasing device is an articulated lever, and the locking insert is a pellet element.

6. The closure system according to claim 5, wherein the footwear comprises a casing housing the rotatable movable displacer, and the locking device.

7. The closure system according to claim 5, wherein the articulated lever is mounted to a rear of the body.

8. The closure system according to claim 7, wherein the at least one tension element and a connector are attachments selected from the group consisting of cables, strings, chords, and straps.

9. The closure system according to claim 5, wherein the activation device comprises an inner sole.

10. The closure system according to claim 5, wherein the activation device is connectable to the at least one tightening mechanism via a link plate.

11. The closure system according to claim 5, wherein the body further comprises a tongue for covering the cavity, the tongue comprising at least one constricting device for tightening the tongue around a foot of a user, wherein the at least one constricting device is selected from the group consisting of a strap, a tie, a belt, a lace, a string, a wire, a cable, and a hook-and-loop fastener.

12. The closure system according to claim 11, wherein the at least one constricting device is connectable to an end of the at least one tension element.

13. The closure system according to claim 11, wherein the raised configuration is defined by an offset with respect to ground that is formed by the activation device when the foot of the user is removed from the body, and wherein the depressed configuration is defined by the activation device being substantially parallel to the ground when the foot of the user is received in the body.

14. A weight-activated tying footwear comprising the closure system according to claim 1.

15. The weight-activated tying footwear according to claim 14, further comprising a lace lock comprising:

a top member comprising a first aperture defining a primary channel traversing the top member from a first end to a second end; and a bottom member shaped to fit within the primary channel traversing the top member, the bottom member comprising:

a closed top end;

an open bottom end; and a pair of oppositely positioned side-channels shaped and sized to guide at least one lace on opposite sides of the closed top end to converge towards the open bottom end, wherein upon positioning of the at least one lace between the top and bottom members, displacement of the closed top end of the bottom member towards the top member compresses and locks the at least one lace between the side-channels of the bottom member and the primary channel of the top member, and displacement of the open bottom end of the bottom member towards the top member releases the at least one lace therefrom.

16. The weight-activated tying footwear according to claim 14, further comprising a lace tension distributor for distributing tension between a pulling wire and a lace assembly, the distributor comprising:

a first receiving structure on a first side of the distributor configured for receiving the pulling wire; and a second receiving structure on a second side of the distributor configured for receiving the lace assembly, wherein a first effective cross-sectional area of the pulling wire is less than a second effective cross-sectional area of the lace assembly.

17. A closure system comprising:

a body having a base structure and side walls projecting from the base structure so as to define a cavity for receiving an object;

at least one tightening mechanism housed within at least one side wall of the body, the at least one tightening mechanism functionally connectable to the body and operatively responsive to a tightening actuator such that the at least one tightening mechanism tightens the body around the object upon a transition of the tightening actuator between an untightened configuration to a tightened configuration, and the at least one tightening mechanism loosens the body from the object upon a transition of the tightening actuator from the tightened configuration to the untightened configuration, the at least one tightening mechanism comprising at least one linkage assembly, each linkage assembly comprising:

at least one tension element operatively linking the tightening actuator to the body;

a movable displacer for displacing the at least one tension element along a path upon the transition of the tightening actuator from the untightened configuration to the tightened configuration thus tightening the body around the object, and for returning the at least one tension element along the path to an original loose configuration upon the transition of the tightening actuator from the tightened configuration to the untightened configuration thus untightening the body from the object;

a locking device operatively connected to the at least one tension element and removably engageable with the movable displacer, the locking device being operable between a locked configuration wherein the locking device engages the movable displacer, thus preventing movement of the displacer along the path, with a activation device in a depressed configuration, and a displaceable configuration wherein the locking device selectively disengages movable displacer allowing the movable displacer to freely move along the path upon transitioning of the activation device from a raised configuration to the depressed configuration; and a releasing device mounted onto the body and functionally connected to the movable displacer, the releasing device being configured for unlocking the locking device from the locked configuration to the displaceable configuration, wherein the locking device further comprises a locking insert displaceable by movement of the movable displacer and linked to the tension element, the locking insert being removably insertable into a recess formed proximate a trajectory of the movable displacer, whereby, upon entry of the locking insert into the recess, tension is maintained in the tension element independently of the movable displacer and the tightening actuator is disengaged from the tension element, and upon disengaging the releasing device, a movement of the movable displacer removes the locking insert from the recess and relieves tension from the tension element.

18. The closure system of claim 17, further comprising a lace tension distributor for distributing tension between a pulling wire of the tension element and a lace assembly on the body, the distributor comprising:

a first receiving structure on a first side of the distributor configured for receiving the pulling wire; and a second receiving structure on a second side of the distributor configured for receiving the lace assembly, wherein a first effective cross-sectional area of the pulling wire is less than a second effective cross-sectional area of the lace assembly.

* * * * *